US005887530A

United States Patent [19]

Muller

[11] Patent Number: 5,887,530

[45] Date of Patent: Mar. 30, 1999

[54] FITTED FURNITURE COVERS HAVING BUILT-IN DRAINAGE TROUGHS

[76] Inventor: John Muller, 720 Mountain Rd., West Hartford, Conn. 06117

[21] Appl. No.: 932,488

[22] Filed: Sep. 18, 1997

[51] Int. Cl.[6] ..... A47B 13/08

[52] U.S. Cl. ..... 108/90; 135/96; 150/158

[58] Field of Search ..... 108/93, 90, 151, 108/161; 150/158, 154; 297/224, 228.11, 228.12, 228.13, 219.11; 135/96, 90, 99

[56] References Cited

U.S. PATENT DOCUMENTS

| | | | |
|---|---|---|---|
| 1,219,790 | 3/1917 | Taylor | 108/90 |
| 3,279,515 | 10/1966 | Kesh | 108/90 |
| 5,582,115 | 12/1996 | Muller | 108/90 |
| 5,765,487 | 6/1998 | Neff | 108/90 |

*Primary Examiner*—Peter M. Cuomo
*Assistant Examiner*—Gerald A. Anderson
*Attorney, Agent, or Firm*—McCormick, Paulding & Huber

[57] ABSTRACT

A cover for an article of furniture such as an umbrella table assembly or a chaise lounge, provides improved drainage. A portion of the cover associated with an umbrella pole is releasably secured to the pole and maintained in elevated position by the pole to provide a tent-like structure, which includes an annular peripheral skirt depending below the table top. Releasable fasteners for securing a cover to an article secure the cover on the article after the cover has been positioned on the article. The cover extends from the elevated portion at a first angle towards the table top. The cover is manufactured to provide surfaces that are inclined at an angle greater than the first angle when the cover is installed, so that the cover better sheds water and other debris.

13 Claims, 9 Drawing Sheets

FITTED FURNITURE COVERS HAVING BUILT-IN DRAINAGE TROUGHS

BACKGROUND OF THE INVENTION

The present invention relates generally to furniture covers, and relates more particularly to improved in covers for covering casual or outdoor furniture.

The present invention is particularly concerned with improvements in covers and covering methods for porch and patio furniture, such as umbrella tables, chairs and chaise lounges. Such outdoor furniture is produced by a large number of manufactures in a wide variety of designs.

Ready-made covers for such furniture generally lack the adaptability required to enable satisfactory performance with a wide range of furniture designs. Consequently, covers have been developed that adapt to enable satisfactory performance with such range of furniture designs, such as the covers described and claimed in U.S. Pat. No. 5,582,115 entitled "Outdoor Furniture Covers and Covering Methods", which is expressly incorporated by reference herein. The disadvantages of previous ready-made covers are described in and overcome by covers and methods set forth in the above referenced patent, which also discusses the advantages provided by the novel covers and methods of the '115 patent.

When installed, the covers of the '115 patent extend from an elevated portion of the article or articles of furniture to be covered, such as from an umbrella pole of an umbrella table assembly or a raised, back portion of a chair, down towards a lower portion of the furniture, such as the periphery of an umbrella table or a seat or foot of a chair. The covers are designed so that, when peripheral portions of the cover are installed at specified mounting points on the article to be covered, the cover is tensioned over the article being covered. Since the fabric is light weight, a cover which has been fitted to and mounted in tension on the article extends generally in a straight line down from the elevated portion to the lower portion, and may not be inclined sufficiently to shed all water and other debris which comes to rest on the cover.

Where the cover is positioned over an article, the '115 patent also suggests a method for forming drainage troughs by pinching the covers between two chairs. However, the cover may be displayed relative to the article being covered if the cover is loaded, for example by wind, wet leaves, snow or other debris, and consequently the troughs are lost.

The present invention is concerned with the above-mentioned general problems. Accordingly, it is the general object of the present invention to provide an improved durable lightweight furniture cover which automatically forms drainage troughs when mounted on an article to be covered, and which avoids the problems discussed above.

SUMMARY OF THE INVENTION

In accordance with the present invention, a cover assembly for an umbrella table assembly is provided. The assembly includes a table having a table top, which defines a table surface having a peripheral edge. An umbrella of the table assembly includes an umbrella pole, which projects upwardly from the table top. The cover assembly includes a cover made from flaccid sheet material, with an area of coverage substantially greater than the area of the table surface. The cover defines a plurality of segments, and has an inner marginal portion which defines an aperture sized to receive the umbrella pole therethrough. Each of the segments has two sides, which extend from the inner marginal portion and define an angle therebetween. When the segments lie in a plane, e.g., flat, the total of the angles of the segments exceed 360°.

The cover assembly also includes a first securing means for releasably securing the inner marginal portion of the cover to the umbrella pole at a location along the pole and spaced above the table top, in order to form the cover into a tent-like structure having an apex at the umbrella pole. The cover extends and radiates outwardly and downwardly from the apex and towards the peripheral edge of the table, such that each segment defines a trough extending between the apex and the peripheral edge of the table.

According to another aspect of the invention, a cover assembly is provided for an umbrella table assembly. The table assembly includes a table having a table top, which defines a table surface having a peripheral edge, and a plurality of chairs arranged in seating position around the table. The chairs each have upper portions positioned upwardly from the table top. The cover assembly includes a cover made from flaccid sheet material and having an area of coverage substantially greater than the area of the table surface. The cover defines a center and a plurality of segments, each having two sides extending from the center and defining an angle therebetween. The angles of the segments totaling greater than 360°when the segments lie in a plane. The area of coverage is of sufficient size to define a depending skirt portion of the cover, which extends downwardly beyond the upper portions of the chairs and the table top and terminates at an annular outer marginal portions spaced downwardly from the table top. The cover extends generally across the upper portions of the chairs to form ridges, and defines troughs between the ridges.

Figure 1:
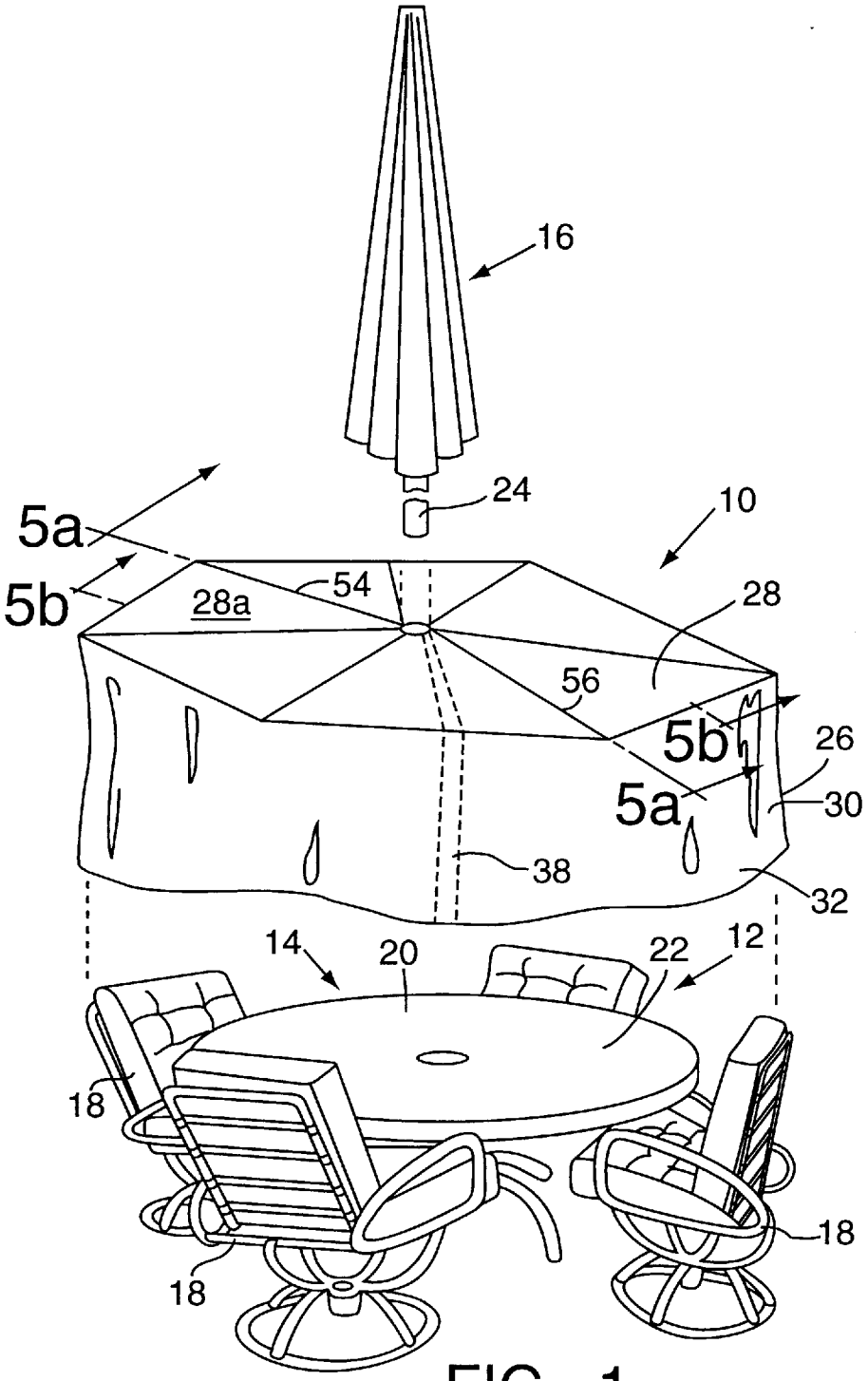
FIG. 1 is an exploded perspective view of a table assembly and a cover assembly embodying the invention for covering the table assembly.

5*a* is a sectional, view of the assemblies taken along the line 5*a*—5*a* of FIG. 1, illustrating ridges formed between two segments of the cover assembly.

Figure 5A:
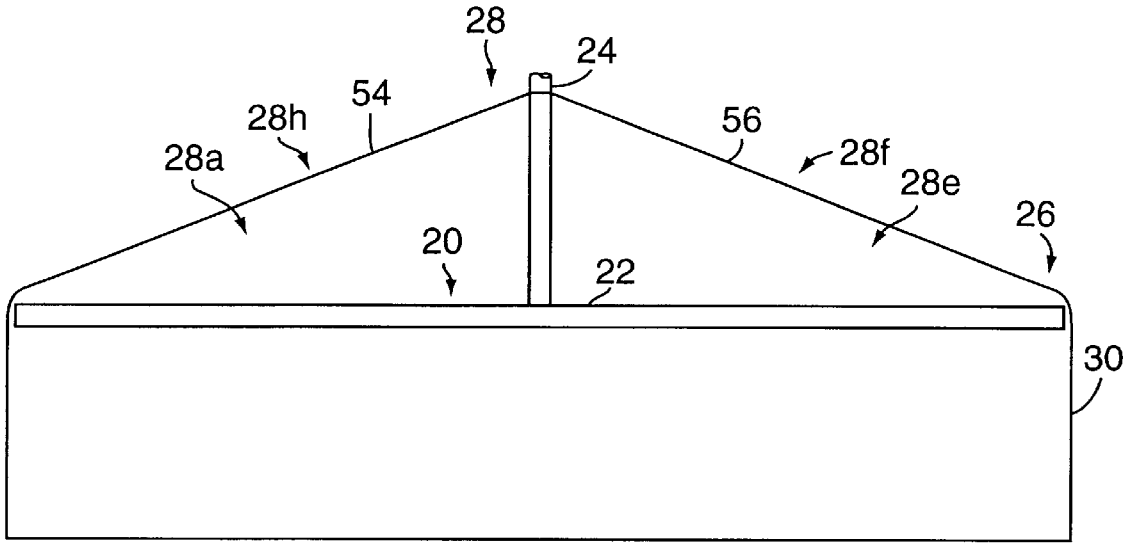
Figure 5B:
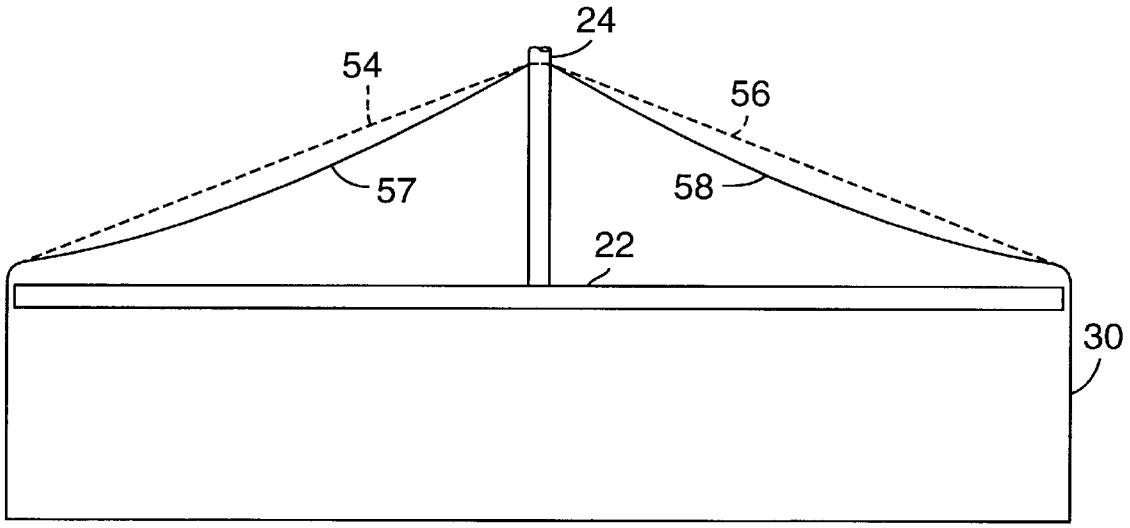

FIG. 5*b* is a sectional, view of the assemblies taken along the line 5*b*—5*b* of FIG. 1, illustrating troughs formed by two segments of the cover assembly.

Figure 2:
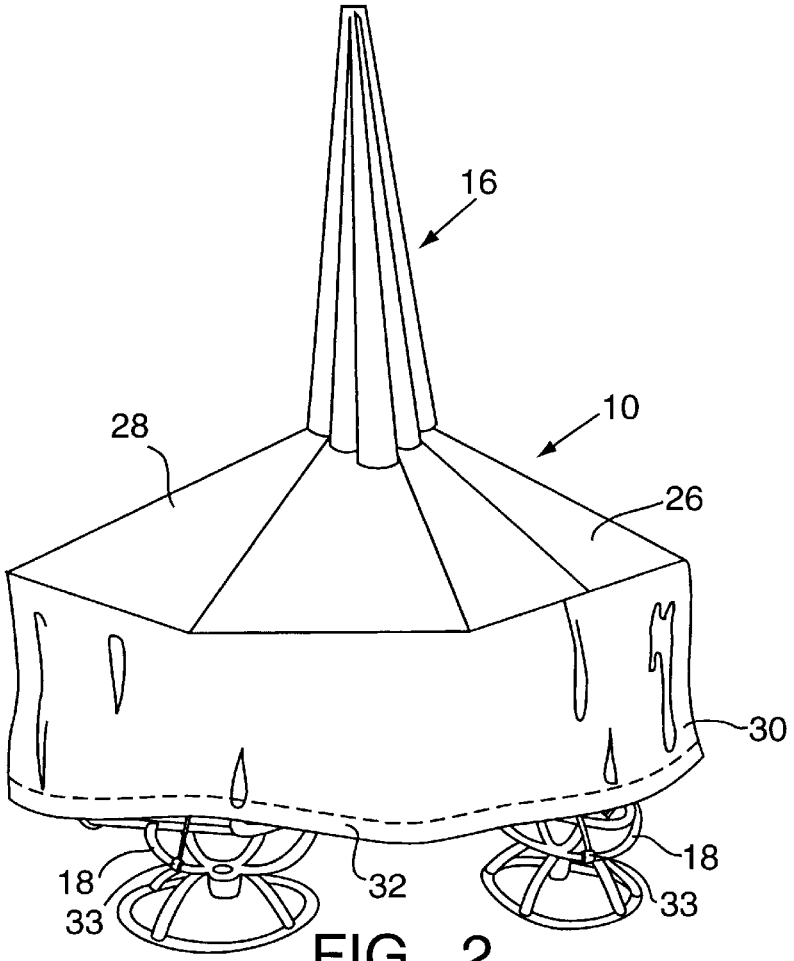
FIG. 2 is a perspective view showing the cover assembly in covering position on the table assembly.
Figure 5C:
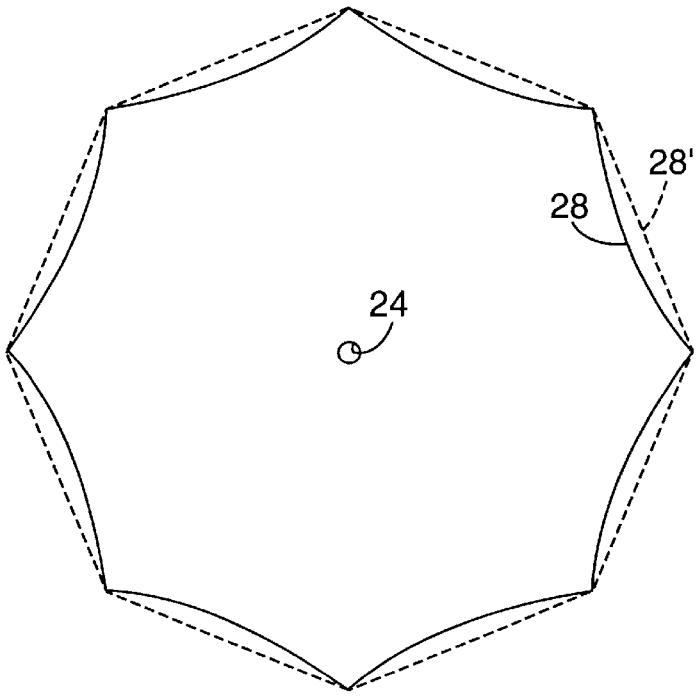

FIG. 5*c* is a sectional view of the cover assembly of FIG. 2, taken in a plane perpendicular to the umbrella, and above the table between the table and the apex of the cover assembly.

Figure 6:
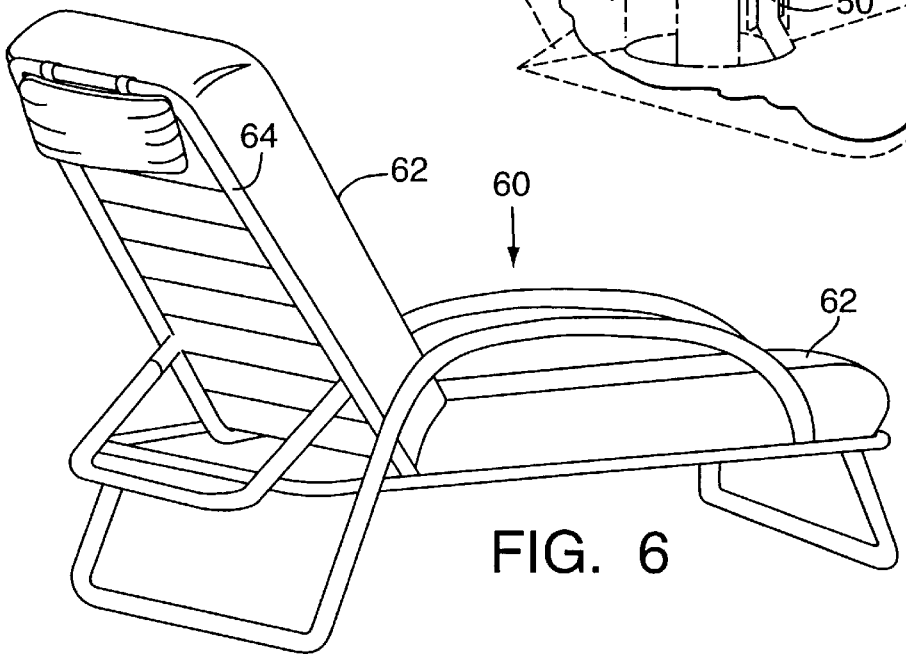

FIG. 6 illustrates a typically chaise lounge chair.

Figure 7:
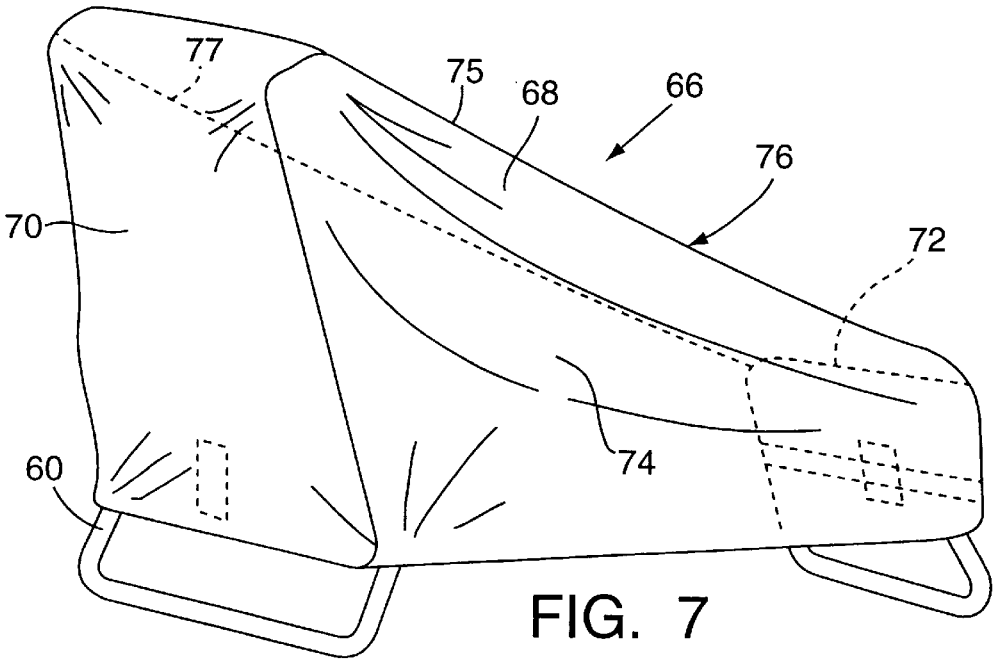

FIG. 7 shows the chair of FIG. 6 in covered position by a second embodiment of a cover assembly made in accordance with the present invention.

Figure 8:
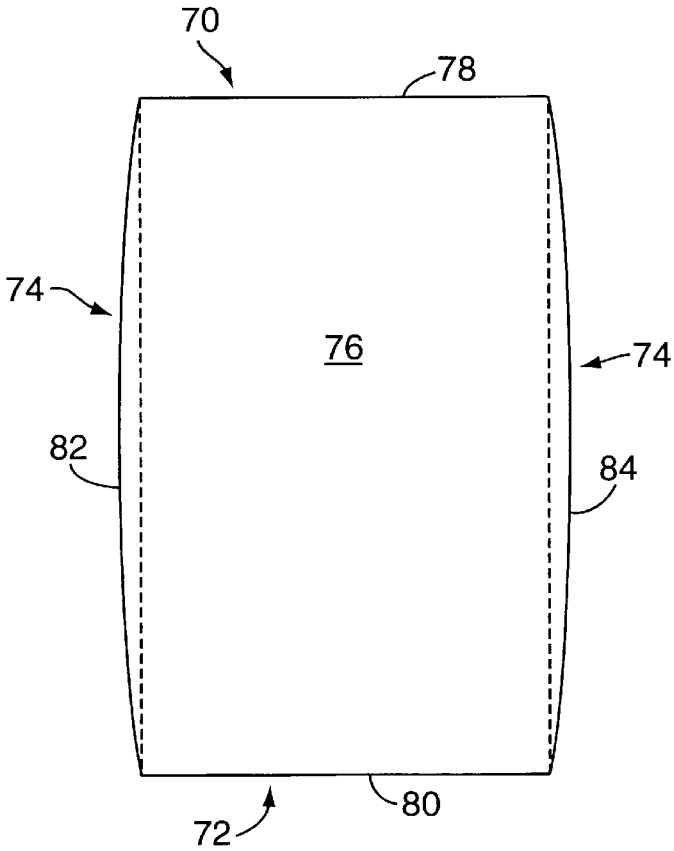

FIG. 8 is a top plan view of a top panel of the cover of FIG. 7, illustrating the shape of the top panel.

Figure 9:
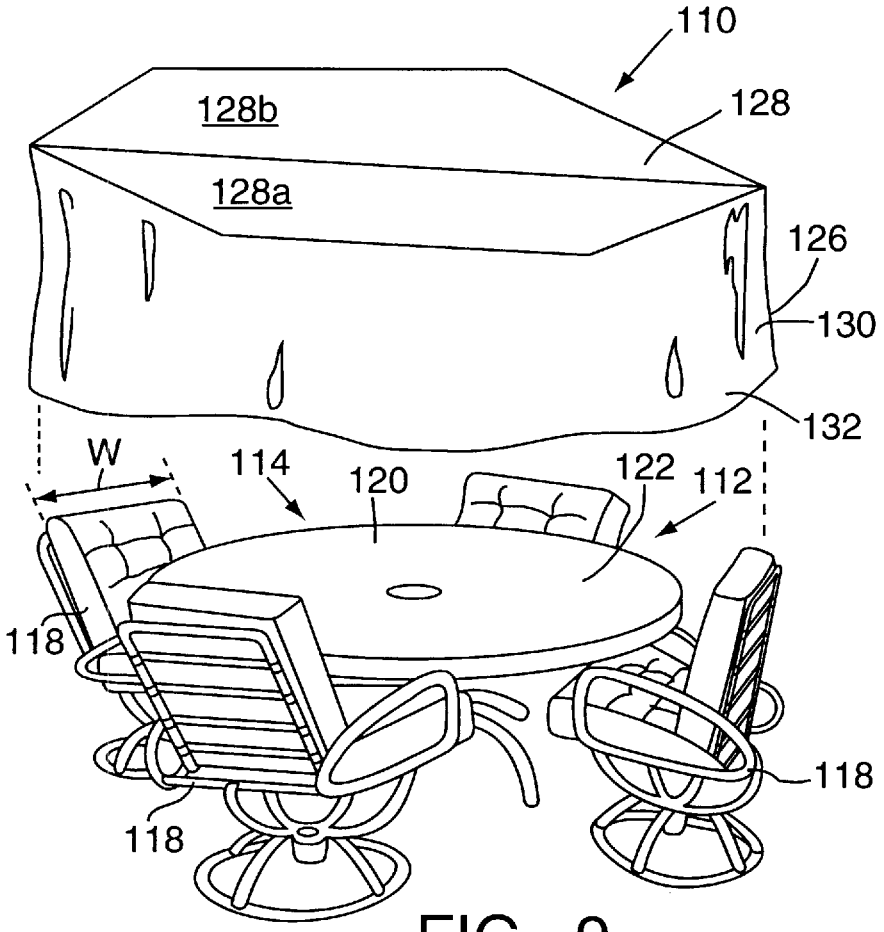

FIG. 9 is an exploded perspective view of a table assembly and a cover assembly embodying another embodiment of the invention for covering the table assembly.

Figure 10:
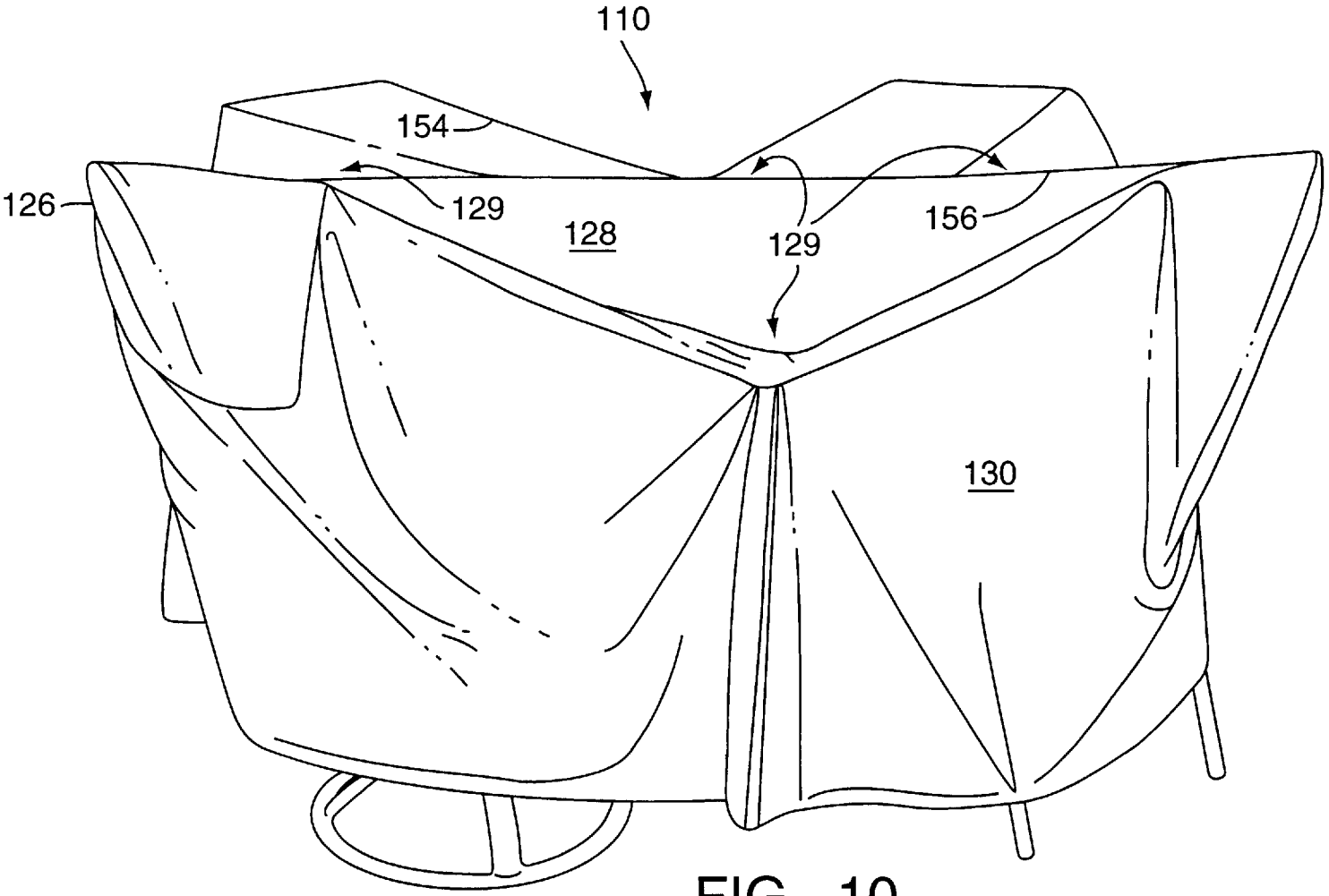

FIG. 10 is a perspective view showing an other embodiment of the cover assembly in covering position on the table assembly.

Figure 11:
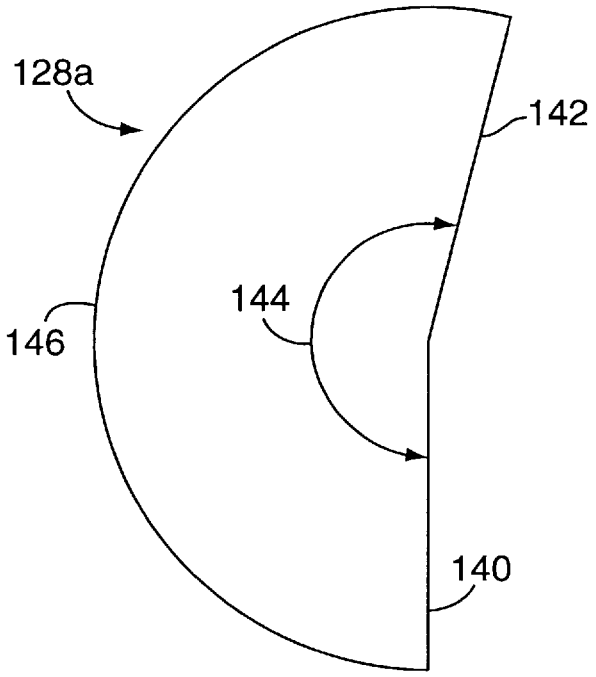

FIG. 11 is a top plan view illustrating an exemplary shape of a segment of the cover assembly of FIG. 10.

Figure 12:
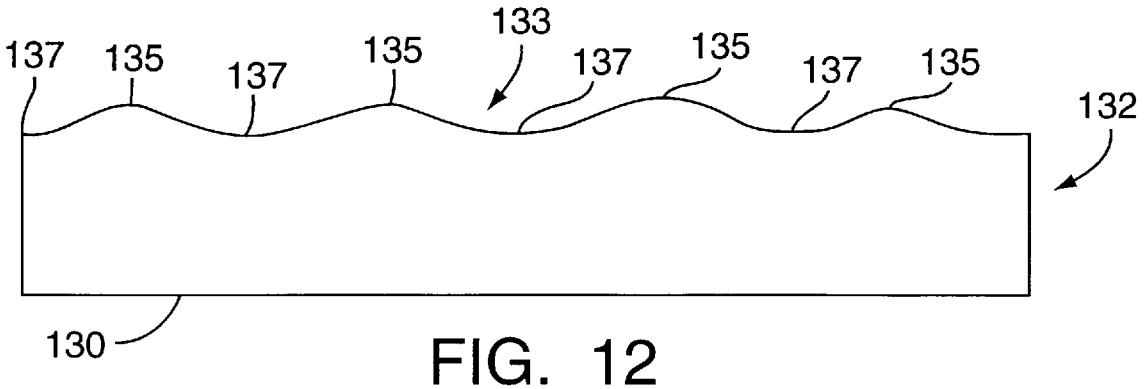

FIG. 12 is a side view of a depending skirt portion of the cover assembly of FIG. 10.

Figure 13:
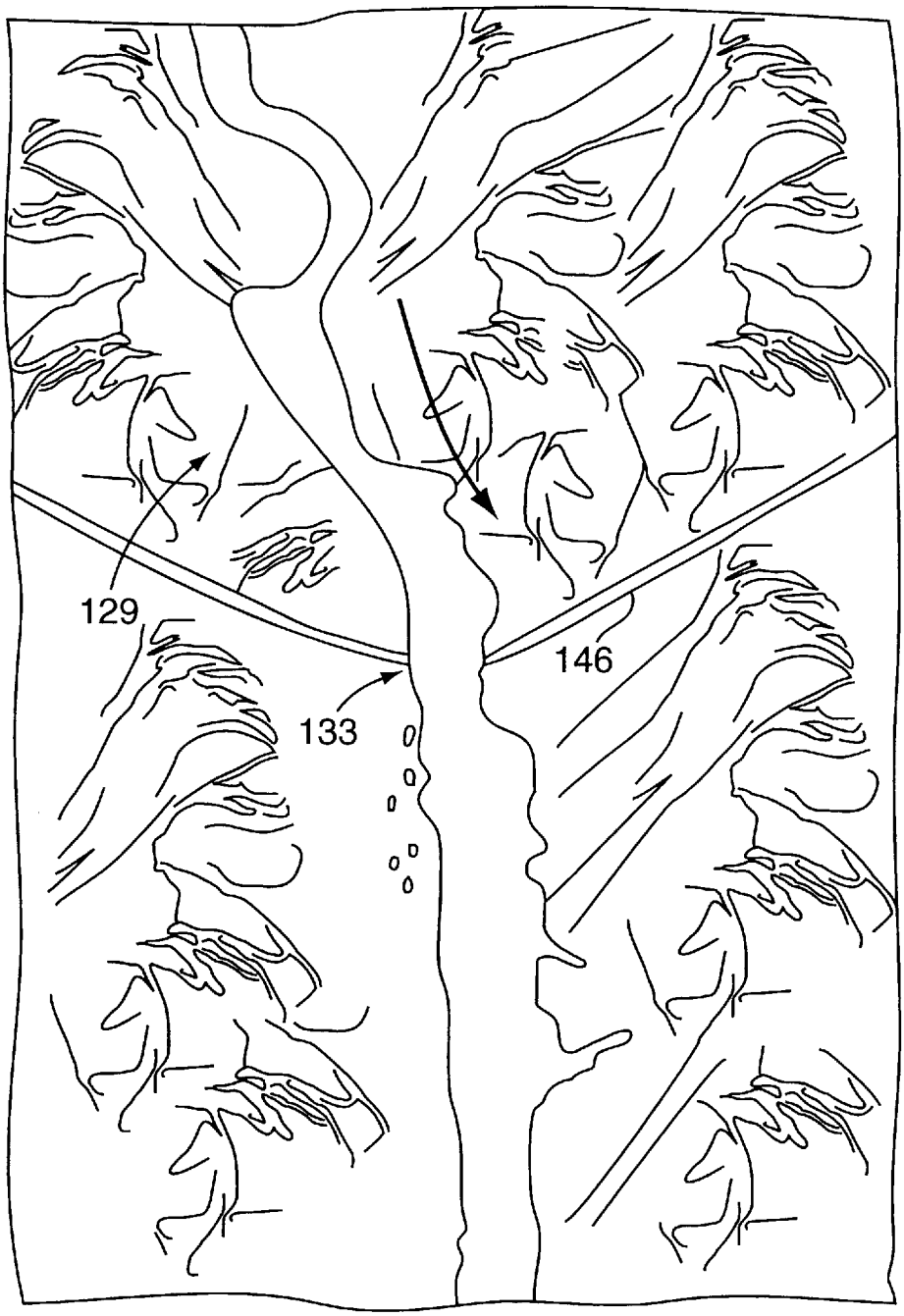

FIG. 13 is an end view of a drainage trough of the cover assembly of FIG. 10, illustrating a liquid flowing generally along the trough.

DETAILED DESCRIPTION OF PREFERRED EMBODIMENTS

Turning now to FIG. 1, a cover assembly embodying the present invention is indicated generally by the reference numeral 10. The illustrated cover assembly 10 is particularly adapted to cover an umbrella table assembly, which is indicated generally at 12 and includes at least a table 14 and a collapsible umbrella 16. However, the illustrated cover assembly 10 may also cover a plurality of chairs 18, 18, which are arranged in a general seating position around the table and comprise a part of the table assembly. The illustrated table 14 has a generally circular table top 20 and a table surface 22. The umbrella 10 is supported on the table in a conventional manner by an umbrella pole 24 which projects upwardly from the table top 20.

The illustrated cover assembly 10 of FIGS. 1 and 2 includes a cover 26 which has a top panel 28. The top panel 28 includes a number of segments, each having a shape generally illustrated in FIG. 3*a*. While the top panel is illustrated as including 8 segments, no particular number of segments is required by the present invention. An annular peripheral skirt 30 of the cover assembly is sewn or otherwise suitably connected to the outer peripheral edge of the top panel 28, and depends from the top panel and terminates at an outer marginal portion 32 defined by a hem to which several hook-type fasteners 33, 33. The fasteners are attached to the cover assembly using resilient straps, which enable the cover assembly to yield when loaded, for example by wind, snow, wet leaves or other debris.

The cover 26 defines an area of coverage substantially greater than the area of the table surface 22 and is made from a light-weight flaccid water-resistant sheet material, such as is marketed by DuPont under the trademark TYVEK. The size and shape of sheet material forming the cover 26 may vary and will generally be determined by the shape of the table assembly to be covered. The illustrated cover 26 is particularly adapted to cover the table assembly 12, including both the circular table 14 and a plurality of associated chairs 18, 18 and, for this reason, the top panel 28 has a generally rounded configuration as best shown in FIG. 3.

Figure 3:
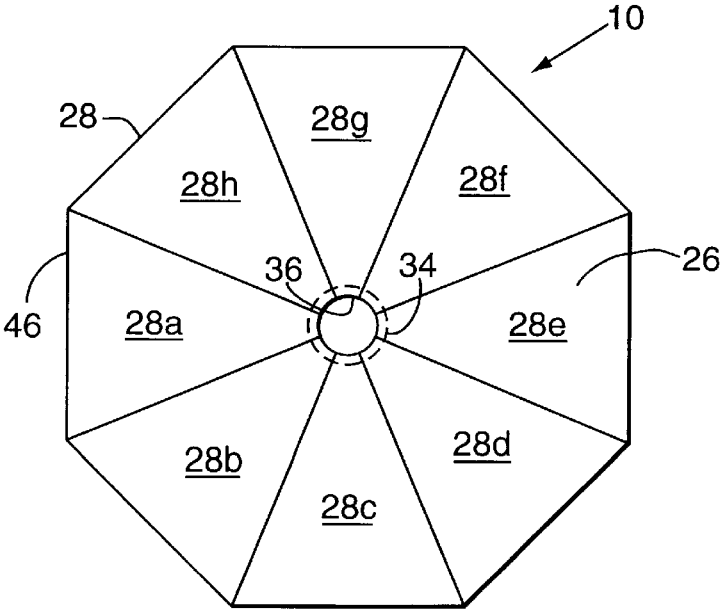
FIG. 3 is a top plan view of the cover assembly illustrating multiple segments of the cover assembly.

With reference to FIG. 3, the top panel 28 comprises a number of segments, in the illustrated case 8 segments, 28*a*, 28*b*, 28*c*, 28*d*, 28*f*, 28*f*, 28*g*, 28*h*, and has an inner marginal portion 34 which defines an aperture 36 sized to receive the umbrella pole 24. While not necessary to the present invention, a rectangular slit 38 (illustrated in dashed lines) may extend from the aperture 36 through the top panel and through the annular skirt 30 to and through the outer marginal portion 32 separating contiguous portions of the cover 26 from each other, as is described in the '115 patent.

Figure 3A:
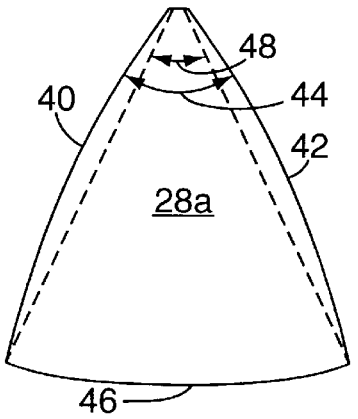
FIG. 3*a* is a top plan view illustrating an exemplary shape of a segment

FIG. 3*a* illustrates an exemplary segment 28*a*, and as noted above, the cover comprises a number of such segments. The segment 28*a* has sides 40, which are generally coextensive at one end and form an angle 44 relative one another, and terminate generally at an outer portion 46, which is illustrated as arcuate, but may also be straight, to correspond to the periphery of the table. The depending skirt portion is not shown in FIGS. 3 or 3*a*. As shown in FIG. 3, the total length of the outer portion is about equal to the periphery of the table 20.

In FIG. 3, each segment appears to have a generally triangular shape. However, and as shown best in FIG. 3*a*, while each segment is generally triangularly shaped, the sides of each segment are arcuate rather than straight. For an outer portion having a given length the angle 44, when measured between a portion of the sides 40, 42 other than at the outer portion 46, defines an angle greater than an angle 48 which would be formed if the sides were straight. For example, if the sides of each segment were triangular, and there were 8 identical segments, each angle would be about 45° and the sum of the 8 angles would be 360°. However using the segments as illustrated in FIG. 3*a*, each angle is greater than about 45°, and thus the sum of the angles 44 is greater than 360°.

The segments may comprise separate fabric panels which are assembled by sewing, or a single panel of fabric which is gathered and sewen, or a single fabric panel which is cut to form panels, or by other suitable means. Each segment is illustrated as having a shape identical to the other segments, e.g., since the umbrella pole extends through the center of the table and thus the cover provides an umbrella receiving aperture corresponding to the center of the table. It is noted that the segments need not be identically shaped.

Figure 4:
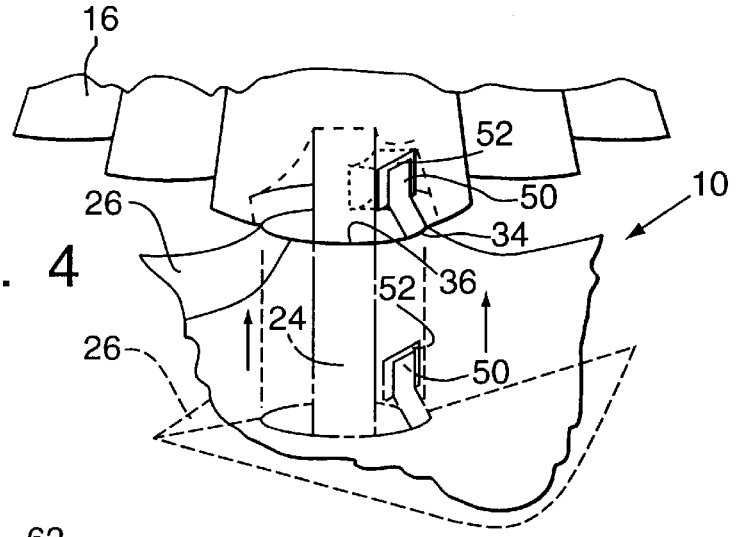
FIG. 4 is a somewhat enlarged, fragmentary and sectional view of a portion of the cover including the pole-receiving aperture.

A flexible strap 50 is shown in FIG. 4 and comprises a part of the cover assembly. The strap 50 is sewn or otherwise secured in fixed position to the cover 26 near the inner marginal portion 34, for attaching a central portion of the cover to the umbrella pole. The preferred strap 50 comprises one part of a releasable hook and loop fastener. A corresponding part of the hook and loop fastener 52 is releasably attached to the free end of the strap 44, and is covered by a suitable release material.

The cover 26 is positioned to cover the table assembly generally as described in the '115 patent. Briefly, the strap 50 of the inner marginal portion 34 of the cover is attached to the corresponding strap 52 mounted to the umbrella pole 24. The outer marginal portion of the cover is secured to the table assembly below the table top, for example by attaching the hook-type fasteners to a suitable portion of the chairs or to a suitable portion of the table, in order to tension the cover. When the cover is in its generally covering position, the top panel cooperates with the umbrella pole 24 to form a tent-like structure having an apex at the umbrella pole 24 and radiating outwardly and downwardly from the apex toward the peripheral edge of the table 14. As previously noted, the area of coverage provided by the cover 26 is substantially greater than the area of the table surface 22 and is of sufficient size so as to cover both the table and the chairs, and to extend downwardly beyond the table top to terminate above the surface on which the tables and chairs are supported.

With reference to FIGS. 5*a*, 5*b*, and 5*c*, the cover 26 is installed on the table assembly. If triangular segments were used for the top panel 28, and installed cover would have a generally conical shape, except that the "cone" would be formed by multiple flat surfaces extending from the apex towards the table periphery, especially where the cover is installed and tensioned as described in the '115 patent. However, by incorporating segments of the type shown FIG. 3*a* and described above, one side of each segment cooperates with an adjacent side of an adjacent segment to form a ridge 54, 56 which extends from the apex located at the umbrella pole downwardly to the table periphery. The ridges 54, 56 are illustrated by solid lines in FIG. 5*a* and dashed lines in FIG. 5*b*. Moreover, each segment defines a drainage trough, 57, 58 which is positioned between adjacent ridges. The troughs, 57, 58 are illustrated by the dashed lines in FIG. 5*a* and the solid lines in FIG. 5*b* Each drainage trough is characterized by a portion having a slope which is steeper than the ridges 56, 58 which extend from the apex to the table periphery, and which promotes enhanced shedding of water and other debris from the cover.

Since the drainage troughs are built into the cover, the troughs are not displaced by wind or debris which comes to rest on the cover. Accordingly, the benefits of the drainage troughs remain even where the cover remains installed for long periods of time. The shape of the segments likewise promotes a more even distribution of loads when the cover is loaded, for example by snow or a mass of wet leaves, and accordingly the presently-designed cover is less prone to failure under such heavy loads.

Turning now to FIGS. 6 and 7, a covering system of the general type described above is illustrated and described with reference to a chaise lounge 60, and may be attached to the chaise in the manner described in the '115 patent. The illustrated chaise lounge 60 is of a conventional type, with a elongated couch-like seat 62 and a raised back support 64, which is located at one end of the seat and is substantially higher than the opposite end of the seat. The illustrated cover assembly is indicated generally at 66, and includes a cover 68. The cover is formed from a single panel, or from a plurality of panels adhesively sewn or otherwise joined together along lines of attachment. The illustrated, downwardly open cover has a back panel 70, which extends downwardly from the top of the back support; a front panel 72, which extends downwardly from the top of the front end 62 of the chair; a pair of opposing side panels 74, 74, which extend across the tops of the back and front panels and downwardly therefrom; and a top panel 76, which extends generally between the tops of the back, front and side panels and is inclined downwardly from the upper end of the back panel to the upper end of the front panel.

With reference to FIG. 7, when the cover is installed on the chair 60, the tops of the side panels are generally parallel separated by a distance corresponding to the width of the chaise 60, and extend along ridges 75, 77 from the elevated raised back support 64 of the chaise 60 to the lower seat portion at the front 62 of the chaise. The shape of the top panel 76 gives the cover a drainage trough, and is illustrated in FIG. 8. The top panel 76 includes a pair of generally parallel ends 78, 80, which are positioned adjacent to the respective tops of the back panel 70 and the front panel 72, and a pair of arcuate sides 82, 84, which are positioned adjacent to the tops of the side panels 74, 74. As a result of the arcuate sides, the ends 78, 80 of the top panel 76 each have a length corresponding to the width of the raised back support 64 and the front 62 of the chaise. The central portion of the top panel, between the sides 82, 84 and between the ends 78, 80, is wider than the ends of the top panel. Accordingly, the top panel forms a trough between the ridges when the cover is installed on the chair 60. Since the trough is designed into the cover, the cover provides the same advantages as the cover assembly 10 described above with reference to an umbrella table assembly.

An alternate embodiment to the cover assembly illustrated in FIGS. 1–4 is illustrated in FIGS. 9–11 generally by the reference numeral 110. The cover assembly 110 is similar in many respects to the cover assembly 10 described above, and accordingly, like reference numerals preceded by the numeral 1, instead of 0 are generally used to indicate like elements. Although particular the cover assembly 110 illustrated in FIGS. 9–12 does not include a center aperture for receiving an umbrella pole and is used with a table assembly not including an umbrella, the cover assembly may include a center aperture and be used with a table assembly which includes an umbrella pole.

The cover assembly 110 is particularly adapted to cover an umbrella table assembly, which is indicated generally at 112 and includes at least a table 114 and a plurality of chairs 118, 118, which are arranged in a general seating position around the table and comprise a part of the table assembly. As indicated in FIG. 9, the tops of the chairs 118 are taller than the height of the table surface 122. In addition, the tops of the chairs 118, 118 each have a width W. The illustrated table 114 has a generally circular table top 120 and a table surface 122. The umbrella (not shown) may be supported on the table in a conventional manner by a umbrella pole (also not shown) which projects upwardly from the table top 120.

The illustrated cover assembly 110 of FIGS. 9–12 includes a cover 126 which has a top panel 128. The top panel 128 includes a number of segments, each having a shape generally illustrated in FIG. 11. While the top panel is illustrated as including 2 segments, no particular number of segments is required. A generally annular peripheral skirt 130 of the cover assembly is sewn or otherwise suitably connected to the outer peripheral edge of the top panel 128, and depends from the top panel and terminates at an outer marginal portion 132 to which several hook-type fasteners (not shown) are fastened in a manner similar to that described above. The fasteners are attached to the cover assembly using resilient straps, which enable the cover assembly to yield when loaded, for example by wind, snow, wet leaves or other debris. As shown in FIG. 10, an installed cover assembly 110 extends generally straight across the top of the chairs, and forms drainage troughs 129 generally between the chairs.

Returning to FIG. 9, the top panel 128 comprises a number of segments, in the illustrated case 2 segments, 128*a*, 128*b*. FIG. 11 illustrates an exemplary segment 128*a*, and as noted above, the cover comprises one or more such segments. The segment 128*a* has sides 140, which are generally coextensive at one end and form an angle 144 relative one another, and terminate generally at an arcuate outer portion 146. As shown in FIGS. 9 and 10, the total length of the outer portion is about equal to the periphery of the table 20.

As shown best in FIG. 11, each segment has a generally semicircular shape. However, each segment is slightly greater than semicrcular. Accordingly and as is the case for the segments of the cover assembly 120, the angles 144 of each segment 128*a*, 128*b* of the alternate cover assembly 110 total greater than 360°.

The top panel 128 is fastened to the skirt 130, which is illustrated separately in FIG. 12. The skirt 130 includes the outer marginal portion 132 which defines the bottom of the skirt, the length of which generally corresponds to the periphery of the table, and an upper portion 133, the total length of which corresponds to the sum of the outer portions 146 of the top panel segments 128*a*, 128*b*. As is the case with the cover assembly 10 described above, the outer portion 146 of the top panel 128 extends generally around the periphery of the table 114. However, the top panel 128 also extends around the tops of the chairs, and accordingly the sum of the outer portions 146 of the top panel, in turn, depends upon the length of the periphery of the table and the difference in height between the table surface 122 and the tops of chairs 118,, 118 arranged generally in a seating arrangement about the table. In order to properly align with the outer portions 146 of the top panel 128, the upper portion of the skirt 130 is curvilinear, and the particular shape depends upon the periphery of the table top 20 and the difference in height between the table surface 122 and the tops of the chairs 118, 118. Since the illustrated table assembly includes four chairs, the upper portion 133 includes four peaks 135, and a corresponding number of valley 137 which form the bottom of the drainage troughs 129.

The cover 26 is positioned to cover the table assembly generally as described in the '115 patent. Briefly, the strap 50 of the inner marginal portion 34 of the cover is attached to the corresponding strap 52 mounted to the umbrella pole 24. The outer marginal portion of the cover is secured to the table assembly below the table top, for example by attaching the hook-type fasteners to a suitable portion of the chairs or to a suitable portion of the table, in order to tension the cover. When the cover is in its generally covering position, the top panel cooperates with the umbrella pole 24 to form a tent-like structure having an apex at the umbrella pole 24 and radiating outwardly and downwardly from the apex toward the peripheral edge of the table 14. As previously, the area of coverage provided by the cover 26 is substantially greater than the area of the table surface 22 and is of sufficient size so as to cover both the table and the chairs, and to extend downwardly beyond the table top to terminate above the surface on which the tables and chairs are supported.

With reference to FIG. 10, the cover 126 is installed on the table assembly 114 (FIG. 9). By incorporating segments of the type shown FIG. 11 and described above, the segments cooperate with the tops of the chairs 118, 118 (FIG. 9) to form ridges 154, 156 which extend across opposing chairs. The segments also define drainage troughs 159 between adjacent ridges. Each drainage trough is characterized generally by a slope extending from the center of the top panel downwardly to the table periphery, and which promotes shedding of water and other debris from the cover. The slope angel depends generally upon the diameter of the table top 120 and the difference in height between the table surface 122 and the tops of the chairs 118, 118.

The built-in drainage troughs provide benefits similar to those described above, and provide the additional advantage that no umbrella pole is required to form the drainage troughs. The shape of the segments which form the cover also promotes a more even distribution of loads when the cover is loaded, for example by snow or a mass of wet leaves, and accordingly the alternate embodiment of the cover is less prone to failure under such heavy loads. As illustrated in FIG. 13, liquid flows down a trough generally from the center of the cover and over the outer portion 146 of a segment.

While preferred embodiments have been shown and described, various modifications and substitutions may be made without departing from the spirit and scope of the invention. Accordingly, it is to be understood that the present invention has been described by way of example and not by limitation.

What is claimed is:

1. A cover assembly for an umbrella table assembly including a table having a table top defining a table surface having a peripheral edge and an umbrella including an umbrella pole projecting upwardly from the table top, said cover assembly including a cover made from flaccid sheet material and having an area of coverage substantially greater than the table surface, said cover defining a plurality of segments and having an inner marginal portion defining an aperture sized to receive the umbrella pole therethrough, each of said segments having two sides extending from said inner marginal portion and defining an angle therebetween, said angles of said segments totaling greater than 360° when said segments lie in a plane, first securing means for releasably securing said inner marginal portion to the umbrella pole at a location along the pole and spaced upwardly from the table top to form the cover into a tent-like structure having an apex at the umbrella pole and extending and radiating outwardly and downwardly from said apex and toward the peripheral edge of the table with the segments defining troughs extending between the apex and the peripheral edge of the table.

2. A cover assembly as defined in claim 1, wherein said area of coverage is of sufficient size to define a depending skirt portion of said cover extending downwardly beyond the table top and terminating at an annular outer marginal portion spaced downwardly from the table top.

3. A cover assembly as defined in claim 1, wherein said segments are equiangular.

4. A cover assembly as defined in claim 2, further including second securing means for releasably securing said outer annular marginal portion to the table assembly below the table top to tension the cover assembly on the table.

5. A cover assembly as set forth in claim 4, wherein second securing means is further characterized as means for releasably securing said outer marginal portion to chairs which can be arranged about the table.

6. A cover assembly as set forth in claim 5 wherein said second securing means comprises resilient straps.

7. A cover assembly as defined in claim 1, wherein said plurality of segments comprise identically-shaped segments.

8. A cover assembly as defined in claim 1, wherein the sides of the segments extend outwardly and downwardly generally at a first angle from said apex and toward the peripheral edge of the table when the cover is positioned on the table assembly, and the portions of the segments adjacent to said apex extend outwardly and downwardly generally at an angle greater than said first angle.

9. A cover assembly for an umbrella table assembly including a table having a table top defining a table surface having a peripheral edge and a plurality of chairs arranged in seating positions around the table, the chairs each having upper portions positioned upwardly from the table top, said cover assembly including a cover made from flaccid sheet material and having an area of coverage substantially greater than the area of the table surface, said cover defining a center and a plurality of segments each having two sides extending from the center and defining an angle therebetween, said angles of said segments totaling greater than 360° when said segments lie in a plane, said area of coverage being of sufficient size to define a depending skirt portion of said cover extending downwardly beyond the upper portions of the chairs and the table top and terminating at an annular outer marginal portion spaced downwardly from the table top, whereby the cover extends generally across the upper portions of the chairs to form ridges and defines troughs between the ridges.

10. A cover assembly as defined in claim 9, wherein said plurality of segments comprise identically-shaped segments.

11. A cover assembly as defined in claim 9 wherein said segments are equiangular.

12. A cover assembly as defined in claim 9, further including securing means for releasably securing said outer annular marginal portion to the table assembly below the table top to tension the cover assembly on the table.

13. A cover assembly as set forth in claim 12, wherein said second securing means comprises resilient straps.

* * * * *